United States Patent [19]

Hall

[11] 4,246,915

[45] Jan. 27, 1981

[54] PORTABLE COIN BANK

[76] Inventor: A. Douglass Hall, David's Hill Rd., Bedford Hills, N.Y. 10507

[21] Appl. No.: 23,677

[22] Filed: Mar. 26, 1979

[51] Int. Cl.[3] ..... G07D 1/08

[52] U.S. Cl. ..... 133/6

[58] Field of Search ..... 133/1 R, 5 R, 5 A, 5 B, 133/6, 1 A; 221/309, 310; 206/0.84, 0.83

[56] References Cited

U.S. PATENT DOCUMENTS

| | | | |
|---|---|---|---|
| 930,100 | 8/1909 | Stark, Jr. | 133/6 |
| 954,761 | 4/1910 | Palmer | 133/6 |
| 2,431,121 | 11/1944 | Hunter | 133/5 R |
| 2,569,629 | 5/1949 | Everitt | 133/6 |
| 2,644,471 | 2/1950 | Brown | 133/6 |
| 3,059,767 | 10/1959 | Chalfin | 206/0.84 |
| 3,126,897 | 3/1964 | Sharpe | 133/6 |
| 3,206,067 | 9/1965 | Smith, Jr. et al. | 221/309 X |
| 3,316,924 | 10/1965 | Ware | 206/0.84 |
| 3,393,688 | 10/1965 | Saverino | 133/6 |
| 3,675,664 | 7/1972 | Kitowski | 133/6 |

*Primary Examiner*—Stanley H. Tollberg
*Attorney, Agent, or Firm*—Pennie & Edmonds

[57] ABSTRACT

An improved portable coin bank having at least one tubular member configured to retain a stack of coins of a particular denomination and for permitting the lowermost coin of the stack to be manually dispensed as required comprising a lower support portion having an inclined bottom support surface having a first U-shaped cut to facilitate removal of a coin and extending more than half-way around the periphery of the tube, a second U-shaped cut in the front of the tube conterminous with the first U-shaped cut, and a pair of parallel slits on either side of the second opening extending upward from the lower support portion and each pair defining a spring member for retaining the stack of coins and permitting withdrawal of the lowermost coin by flexing radially outward. Between the second U-shaped opening and each spring member there is provided an arched portion which serves to prevent additional coins from being inadvertently dispensed as the lowermost coin is withdrawn. In a preferred embodiment, the improved coin bank comprises three such tubular members each for retaining a stack of coins of a different denomination.

11 Claims, 9 Drawing Figures

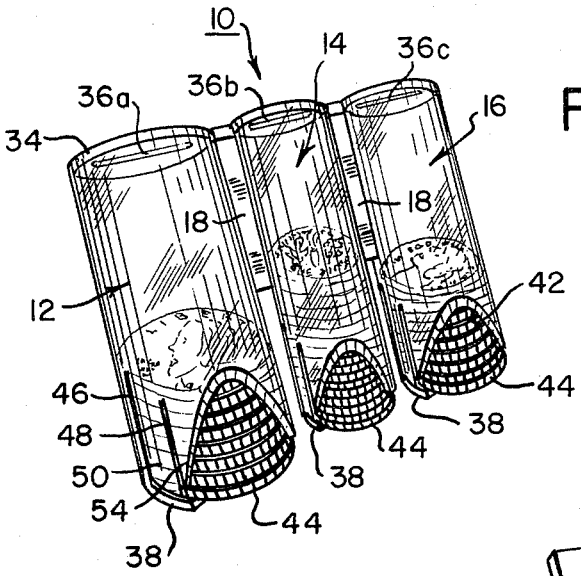
FIG. 2
FIG. 3
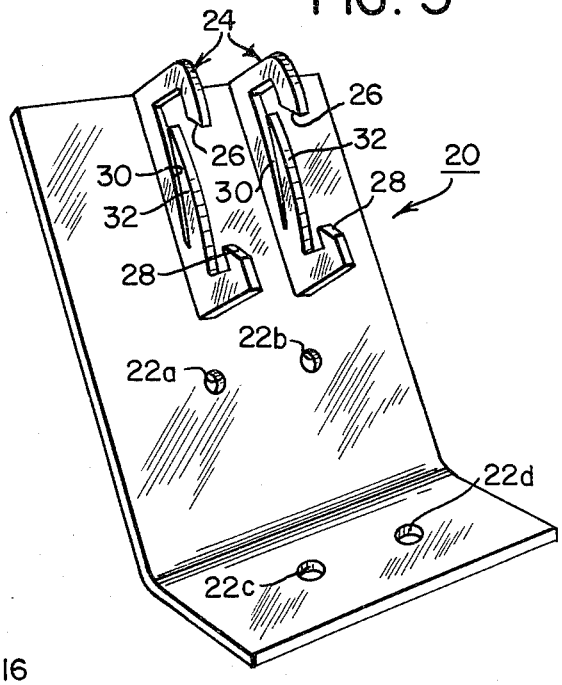
FIG. 9
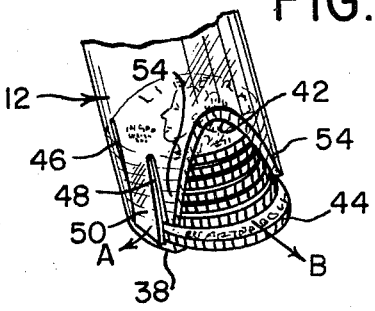
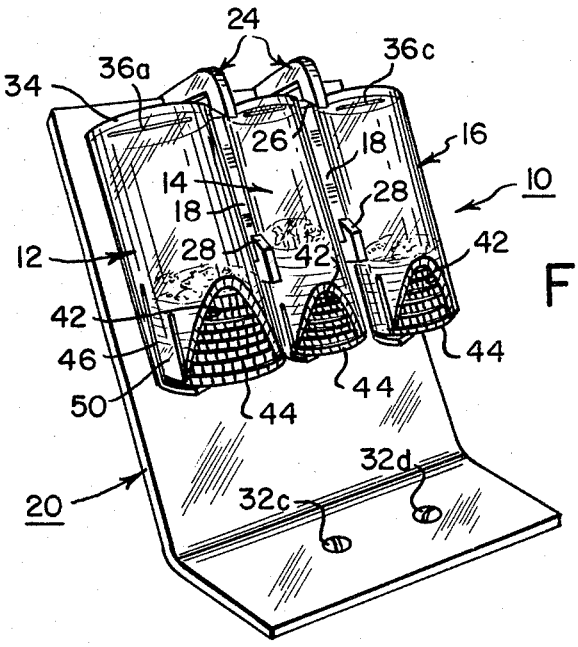
FIG. 1

PORTABLE COIN BANK

TECHNICAL FIELD

This invention relates to improvements in a portable coin bank; and, in particular, a three denomination coin bank for use in automobiles and the like where quick and easy access to coins or other tokens is desirable to individually withdraw coins one at a time.

BACKGROUND ART

A great variety of portable coin banks of various sizes and shapes are known, some of which are particularly designed for use in automobiles.

One such coin holder having three tubes for retaining coins of three denominations is disclosed in U. S. Pat. No. 3,675,664 to Kitowski. The Kitowski coin holder is provided with a removable mounting bracket. In this arrangement each tube has an upper opening through which coins may be either inserted or dispensed. The stack of coins in each of the tubes is forced upward by means of a compression coil disposed therein to continually urge the coins toward the upper opening.

Another example of a multiple coin denomination coin bank for use in automobiles is disclosed in U.S. Pat. No. 3,316,924 to Ware. The Ware device has three grooves for retaining three stacks of coins. The grooves are formed so that an upper shoulder portion encompasses more than one-half of the circumference of the coins retained therein to prevent coins from being inadvertently dispensed. To permit removal of the lowermost coin of each stack, the shoulder portion of each groove terminates short of the bottom edge of the groove.

Another example of a three-compartment coin receptacle is disclosed in U.S. Pat. No. 3,126,897 to Sharpe. Each compartment in the Sharpe coin holder has an upper opening for the insertion of coins and a lower opening for dispensing them. The rear of the receptacle has a tapered portion terminating in an end portion. The end portion converges with tabs of the lower end of the front wall of the receptacle to retain the coins therein. These tabs are resilient and flexible to permit individual removal of coins from each compartment; however, the receptacles are not circular, but rather have a rectangular cross-sectional configuration. Two major deficiencies exist in the coin holder disclosed in U.S. Pat. No. 3,126,897. In the first place, because of the non-circular configuration of the receptacle, a coin deposited therein will not necessarily drop in stacking relation but may fall in a reverse position, thereby causing the receptacle to jam. Secondly, this particular configuration does not ensure that coins will be disposed individually, but rather provides a tendency for more than one coin to be dispensed simultaneously.

DISCLOSURE OF THE INVENTION

Applicant has discovered a portable coin bank comprising at least one tubular member for retaining a stack of coins of a particular denomination. The coin bank stacks coins deposited into each of its tubular members and permits coins to be conveniently dispensed individually by the use of one's fingers. The coin bank uses no moving parts and its operation is fashioned from openings and slots in each tubular member.

In a preferred embodiment, the improved portable bank for tokens such as coins is of the type that includes at least one tubular member for retaining a stacked plurality of coins of a particular denomination having means for depositing coins of said denomination into the tubular member.

In the present improvement, the tubular member comprises a lower support portion having an inclined bottom portion to ensure continuous slanted stacking of the coins as each new coin is deposited to facilitate removal of the lowermost coin, the bottom portion having a first opening at forward portions thereof to permit manual contact with the lowermost coin of the stack to aid in its individual removal. The improvement further comprises a second opening at lower forward portions conterminous with the first opening and in combination therewith to provide digital aid in the removal of the lowermost coin of the stack, spring members formed on either side of the tubular member to normally retain the stack of coins within the tubular member to permit removal of the lowermost coin by flexing radially outward as the lowermost coin is withdrawn, and means for preventing the remaining coins of the stack from being simultaneously dispensed as the lowermost coin is being removed.

Preferably, the first and second openings are generally U-shaped, and each spring means formed by a pair of generally parallel slits in the tubular member extending longitudinally upward from the bottom portion of the tubular member. Moreover, the arched portion of the tubular member between each spring member and the second generally U-shaped opening serves as the prevention means.

In a preferred embodiment of the present invention the portable coin bank comprises at least three tubular members each dimensioned to retain a stack of coins of a particular denomination, means for connecting the tubular members in spaced-apart linear relationship, and support means for removably retaining the connected tubular members.

BRIEF DESCRIPTION OF THE DRAWINGS

FIG. 1 is a perspective view of a three-tube portable coin bank in mounted position.

FIGS. 2 and 3 are perspective views similar to FIG. 1 separately illustrating the three-tube coin bank and its support base, respectively.

FIG. 9 is a fragmentary perspective view of one tubular member of FIG. 1 showing a coin being removed.

BEST MODE FOR CARRYING OUT THE INVENTION

Figure 4:
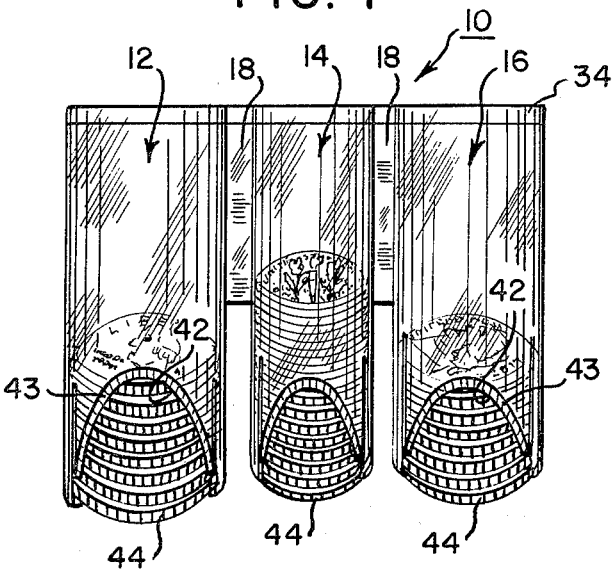
FIGS. 4–8 are respectively a front, rear, plan, bottom, and end view of FIG. 2.

The portable coin bank according to the preferred embodiment illustrated in the drawings is molded from a thermoplastic composition into three tubular members illustrated generally as 10 in perspective in FIG. 2. As is shown therein, by way of illustration only, tubular members 12, 14, and 16 are configured to retain, respectively, stacks of quarters, dimes, and nickels. Such an arrangement is particularly convenient in automobiles for use on toll roads, bridges, and tunnels, especially with the increasing avilability of "exact" toll lanes on such facilities. The several tubular members may be conveniently joined by connecting means such as arms 18 which may be molded integrally with the three tubular members.

FIG. 3 illustrates an example of one convenient support means 20 which is contemplated for use in an automobile in connection with the three-tube arrangement of FIG. 2. The support means 20 is similarly molded from a thermoplastic composition and it may be permanently attached in an automobile accessible by the driver such as on a portion of the dashboard or console. The support means may be permanently attached to the dashboard or console of an automobile by known means such as screws or rivets. For this purpose alternate pairs of holes 22*a*, 22*b*, and 22*c*, 22*d* are provided. The support means also includes a pair of hooks 24 into which arms 18 may be easily snapped to temporarily retain and support the coin bank 10.

To facilitate the insertion of the coin bank 10 into hooks 24, the hooks are provided with slanted top and bottom portions 26 and 28, respectively. To provide a snug fit between the inner opening of each hook 24 and the arm 18 secured therewithin, the inner opening should be but slightly larger than the width of each arm 18. A snug fit is important to avoid unnecessary rattle during an automobile trip. To further ensure a snug fit, the rear portion of each hook 24 has a slot 30 and a corresponding flexible fork 32. The slot 30 permits fork 32 to be pressed backward slightly as the coin bank is inserted, and fork 32 will tend to its normal position thereby maintaining each arm 18 snugly secured within the opening of hook 24. Since support means 20 permits easy removal of the coin bank 10, the latter may be removed quickly and easily for security reasons each time the automobile is left unattended.

FIG. 1 shows the portable coin bank 10 snapped into hooks 24 of retaining means 20 as it would appear on the dashboard of an automobile. The tops of screws 32*c* and 32*d* used to attach the support means 20 to the dashboard are also shown.

Figure 5:
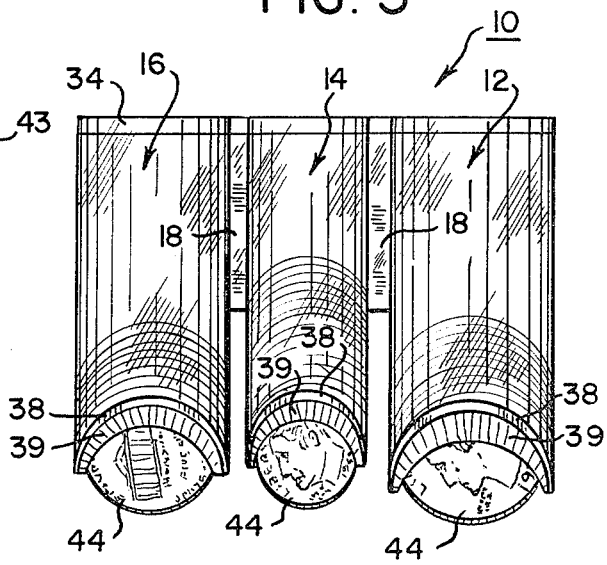
Figure 6:
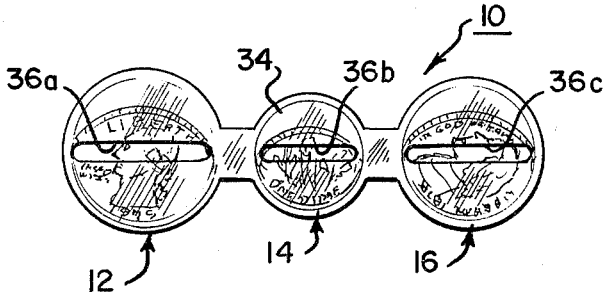

FIGS. 4 through 8 show the portable coin bank in full detail. A front view of the portable coin bank 10 having tubular members 12, 14, and 16 connected by arms 18 is shown in FIG. 4. Coins may be individually inserted into each of these three tubular members through a top portion 34 of the coin bank which is shown in FIG. 6. The top portion 34 is provided with three elongated slots 36*a*, 36*b*, and 36*c* dimensioned to permit the insertion of a quarter, a dime, and a nickel, respectively, therethrough. For convenience, the top portion 34 may also be molded with the three tubular members and the arms 18 in a unitary construction.

Figure 8:
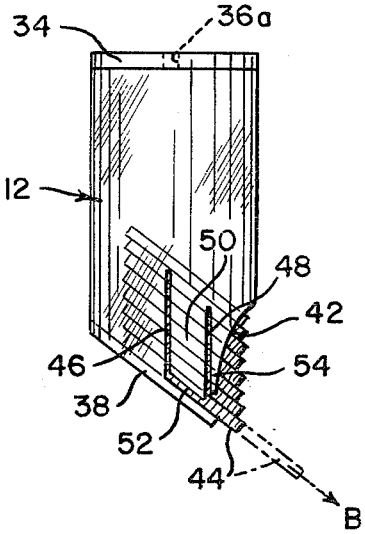

Each tubular member, such as tubular member 12 illustrated in FIG. 8, comprises a lower support portion having an inclined bottom portion 38 which similarly may be attached to the tubular member by glue. It has been found that the combination of the circular configuration of each tubular member and its inclined bottom eliminates jamming of the coins inserted into the tubular member and ensures that the coins are maintained in stacked relation as each individual coin is deposited.

Figure 7:
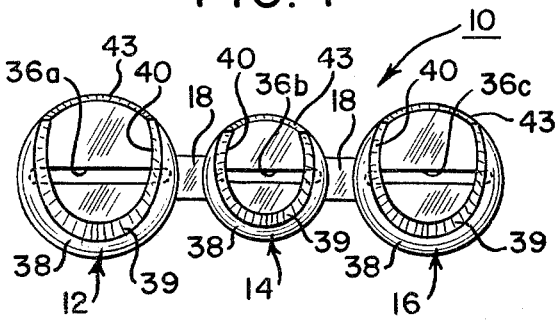

The bottom portion 38 of each tubular member extends more than one-half way around its circumference as shown in the bottom view of the coin bank in FIG. 7. This configuration is necessary to prevent a coin from accidentally dropping through one of the tubular members. Each inclined bottom portion 38 includes a first U-shaped opening 40 which may be formed by slicing away a segment of bottom portion 38 as shown at 39 or simply molded as shown. The stack of coins retained by the lower support portion of each tubular member illustrating the U-shaped openings therein is shown in FIG. 5. As a result of the first U-shaped openings 40 in each tubular member, the lowermost coin 44 in each tubular member is accessible to permit manual contact to aid in its removal whenever desired.

Although bottom portions 38 of each tubular member is shown in the drawings as a separate segment, the three bottom portions may be conveniently molded as one piece (not shown) with a plurality of openings 40. Such a one-piece bottom portion may then be attached to the other unitary construction comprising the three tubular members, top portion 34 and arms 18 by any convenient means such as gluing.

Each tubular member further comprises a second U-shaped opening 42 as illustrated in FIGS. 4 and 8. The second U-shaped opening is provided at a lower forward portion of each tubular member and is conterminous with a corresponding first U-shaped opening 40. Similarly, the second U-shaped opening 42 is formed by slicing away a portion of each tubular member at 43. The combination of the two U-shaped openings permits the combined use of a thumb and a finger to withdraw the lowermost coin 44 of each stack.

Each tubular member is further provided with a pair of generally parallel slits 46 and 48 on either side of second U-shaped opening 42, one pair being shown in FIG. 8. Each pair of slits 46 and 48 defines a spring member 50 therebetween. The spring member 50 is formed from a tubular member. The edge 52 of spring member 50 is slanted in similar fashion to the slant of the bottom portion 38 of the tubular member. The spring member 50 is flexible and will flex radially outward as shown in FIG. 9 by Arrow A as the lowermost coin 44 in being withdrawn generally in the direction of Arrow B. Each tubular member is provided with a pair of spring members 50 such that slit 46 of one of the spring members 50 is diametrically opposite to the slit 46 of the other spring member.

Although spring members 50 on either side of a tubular member flex radially outward to permit the lowermost coin 44 of a stack of coins to be dispensed, the remaining coins in such stack will be retained. This advantageous feature of dispensing coins individually is assured by lower forward portions 54 of each tubular member, particularly the portions between slits 48 and opening 42. Since lower forward portion 54 is unaffected by the outward flexing of spring member 50, the lowermost coin 44 may be withdrawn without permitting any of the remaining coins to be simultaneously removed. The process of removing the lowermost coin can be repeated a great number of times with comparable results and each time the spring members 50 will spring back to their nonextended positions.

I claim:

1. An improved portable bank for tokens such as coins of the type having at least one generally circular tubular member for retaining a stacked plurality of coins of a particular denomination having means for depositing coins of said denomination into the tubular member, the improvement wherein the tubular member comprises:

(a) a lower support portion having an inclined bottom portion to ensure continuous slanted stacking of the coins as each new coin is deposited to facilitate removal of the lower-most coin, said bottom portion having a first opening at forward portions thereof to permit manual contact with the lowermost coin of the stack to aid in its individual removal;

(b) a second opening at lower forward portions conterminous with said first opening and in combination therewith to provide digital aid in the removal of the lowermost coin of the stack;

(c) a pair of spring members formed integrally on either side of each tubular member and facing laterally of said second opening to normally retain the stack of coins within the tubular member and permitting removal of the lowermost coin by flexing radially outward as said lowermost coin is withdrawn; and (d) means for preventing the remaining coins of said stack from being simultaneously dispensed while the lowermost coin is being removed.

2. The portable coin bank according to claim 1 wherein:

(a) said first and second openings are generally U-shaped.

3. The portable coin bank according to claim 2 wherein:

(a) said second opening is defined by a plane which intersects the inclined bottom portion of said lower support portion.

4. The portable coin bank according to any of claims 1, 2, or 3 wherein:

(a) each of said spring members is formed by a pair of generally parallel slits provided in said tubular member extending longitudinally upward from said inclined bottom portion.

5. The portable coin bank according to claim 4 wherein:

(a) one of said slits of one of said pair is diametrically opposed to one of the slits of said other pair; and (b) the other slit of each pair is located between said diametrically opposed pair and said second opening.

6. The portable coin bank according to claim 5 wherein said prevention means comprises:

(a) an arched portion of the lower forward portion of said tubular member between said second generally U-shaped opening and said spring members.

7. The portable coin bank according to claim 1 which comprises:

(a) at least three tubular members dimensioned to retain at least three stacks of coins of at least three denominations.

8. The portable coin bank according to claim 7 further comprising:

(a) means for integrally connecting said tubular members in a spaced-apart linear relation.

9. The portable coin bank according to claim 8 further comprising:

(a) support means for removably retaining said connected tubular members.

10. The portable coin bank according to claim 7 wherein said tubular members are molded of a thermoplastic composition.

11. An improved portable coin bank of the type having at least one generally circular tubular member for retaining a stacked plurality of coins of a particular denomination having means for individually depositing coins of said denomination thereinto, the improvement wherein the tubular member comprises:

(a) lower support portion having an inclined bottom portion to ensure continuous slanted stacking of the coins as each additional coin is deposited in the tubular member to facilitate removal of the lowermost coin, said bottom portion:

(i) extending more than one-half way around the circumference of the tubular member to ensure against unintentionally dispensing a coin, and (ii) having a first generally U-shaped opening at forward portions thereof to permit manual contact with the lowermost coin of the stack to aid in its individual removal;

(b) a second generally U-shaped opening at lower forward portions conterminous with said first generally U-shaped opening and in combination therewith to provide digital aid in the removal of the lowermost coin;

(c) spring members formed integrally on either side of said second generally U-shaped opening each defined by a pair of generally parallel splits extending longitudinally upward from said inclined bottom portion to permit the individual removal of the lowermost coin by flexing radially outward as the lowermost coin is withdrawn; and (d) means for preventing the remaining coins of said stack from being simultaneously dispensed while the lowermost coin is being withdrawn.

* * * * *

UNITED STATES PATENT AND TRADEMARK OFFICE

CERTIFICATE OF CORRECTION

PATENT NO. : 4,246,915

DATED : January 27, 1981

INVENTOR(S) : A. Douglass Hall

It is certified that error appears in the above—identified patent and that said Letters Patent is hereby corrected as shown below:

In Column 1, line 53, "disposed" should read -- dispensed --.

In Column 2, line 62, "avilability" should read -- availability --.

In Column 6, line 18, "lower" should read -- a lower --.

Signed and Sealed this

*Nineteenth* Day of *May 1981*

[SEAL]

*Attest:*

RENE D. TEGTMEYER

*Attesting Officer*

*Acting Commissioner of Patents and Trademarks*